US008002113B1

(12) United States Patent
Cummings

(10) Patent No.: US 8,002,113 B1
(45) Date of Patent: Aug. 23, 2011

(54) MEDICAL SEAL PRODUCT DISPENSER

(75) Inventor: Gary W. Cummings, Richardson, TX (US)

(73) Assignee: Winfield Laboratories, Inc., Richardson, TX (US)

( * ) Notice: Subject to any disclaimer, the term of this patent is extended or adjusted under 35 U.S.C. 154(b) by 43 days.

(21) Appl. No.: 12/157,861

(22) Filed: Jun. 13, 2008

Related U.S. Application Data

(60) Provisional application No. 60/936,629, filed on Jun. 21, 2007.

(51) Int. Cl.
*B65D 85/67* (2006.01)

(52) U.S. Cl. ..... 206/408; 206/409; 206/438; 206/820; 221/70; 242/588.3

(58) Field of Classification Search ..... 206/408, 206/409, 411, 438, 461–464, 470, 471, 817, 206/820; 225/41, 48; 242/588.3–588.6, 242/590, 591; 221/70
See application file for complete search history.

(56) References Cited

U.S. PATENT DOCUMENTS 4,266,687 A 5/1981 Cummings
4,279,359 A * 7/1981 Arnold ..... 221/70
4,390,104 A 6/1983 Cummings
4,423,819 A 1/1984 Cummings
4,514,248 A 4/1985 Cummings
4,527,703 A 7/1985 Cummings
4,598,834 A 7/1986 Singletary, Jr.
4,676,446 A * 6/1987 Ciocarelli et al. ..... 242/588.4
4,700,835 A * 10/1987 Rognsvoog, Jr. ..... 206/411
4,886,204 A * 12/1989 Kalmanides ..... 206/470
5,358,113 A * 10/1994 Hellenbrand ..... 206/411
6,145,780 A * 11/2000 Fontana ..... 242/588.6
6,302,177 B1 * 10/2001 Gruber ..... 242/588.6
6,453,968 B1 * 9/2002 Hsu ..... 242/588.6
2004/0124305 A1 * 7/2004 Huang ..... 242/588.6
2004/0149798 A1 * 8/2004 Hoffman et al. ..... 242/588.6

OTHER PUBLICATIONS

Winfield Laboratories SecurSeal medical seal product dispenser, 3 photographs, prior art.

* cited by examiner

*Primary Examiner* — Luan K Bui
(74) *Attorney, Agent, or Firm* — Roger N. Chauza, P.C.

(57) ABSTRACT

A medical seal dispenser having a container molded of plastic and having clamshell portions hinged together. The clamshell portions of the container can be locked together when in a closed position. One clamshell portion includes a core holder for holding a roll of medical seals. The core holder includes speed bumps that are raised or domed protrusions on the core holder to provide rolling friction to the roll of medical seals during dispensing. This controlled rotation of the roll prevents spooling if the carrier strip is pulled out of the container too quickly.

20 Claims, 5 Drawing Sheets

FIG. 2
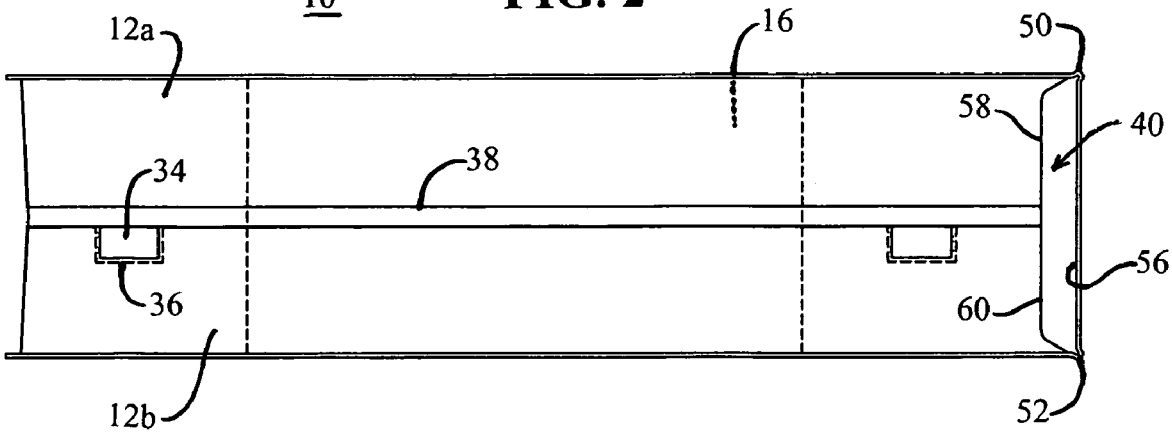
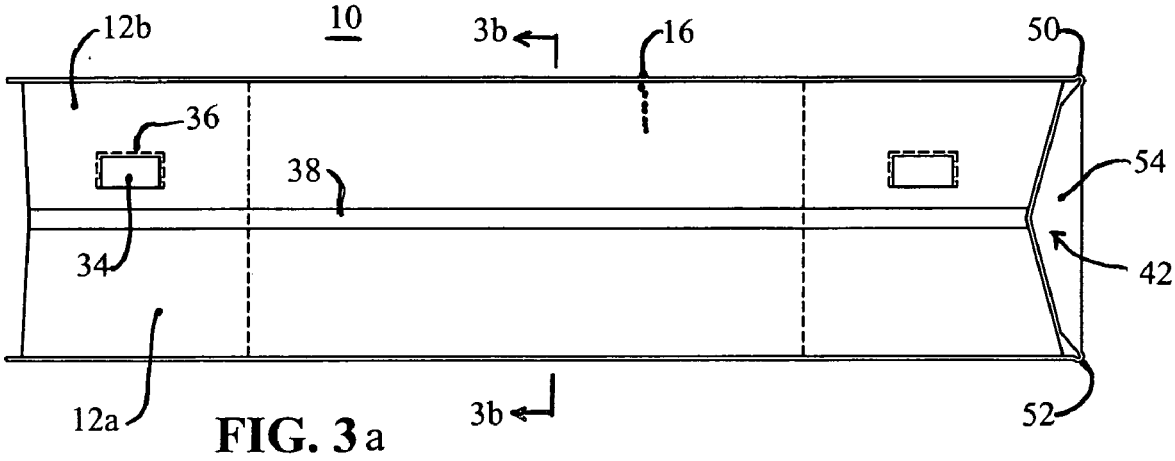
FIG. 3a
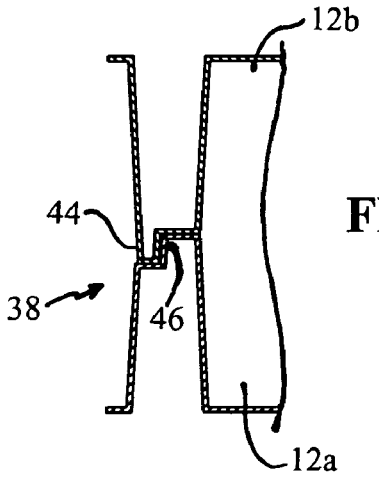
FIG. 3b

MEDICAL SEAL PRODUCT DISPENSER

RELATED APPLICATION

This non-provisional patent application claims the benefit of provisional patent application filed Jun. 21, 2007, Ser. No. 60/936,629, entitled "Medical Seal Product Dispenser."

TECHNICAL FIELD OF THE INVENTION

The present invention relates in general to packaging methods and apparatus, and more particularly to the fabrication of a medical seal dispenser.

BACKGROUND OF THE INVENTION

Medical seals are used to cap the port of an IV bag or other medical container after the contents of the container have been modified by a pharmacist or other technician. IV containers generally contain conventional liquid solutions, such as dextrose, sodium chloride, etc., to which the pharmacist adds a drug or solution as prescribed by the physician. The pharmacist first selects an IV bag having the appropriate solution therein, and removes the original seal that seals the injection port. This procedure is carried out in a sterile environment so as not to contaminate either the contents of the IV bag, the membrane of the port or the sterile surface of the medical seal. The drug is generally added by filling a syringe with the drug, inserting the syringe needle into the sterile, self-sealing rubber membrane covering the injection port, and injecting the drug into the solution in the IV bag. A medical seal is then removed from a carrier strip pulled from a dispenser box, and the sterile side of the seal is applied over the injection membrane. Medical seals are generally constructed with tear slits so that when removed from the port of a medical container, telltale pieces of the seal remain on the port to provide a nurse or other attendant an indication that the IV bag may have been tampered with, such as by an unauthorized or inadvertent injection of a fluid into the bag.

Medical seals are manufactured with many features to facilitate the identification of the drug injected into the IV bag, to detect tampering of the seal, and to assist the attendant in the application and removal thereof from the injection port of the medical container. Various medical seals are disclosed in U.S. Pat. Nos. 4,266,687 by Cummings; 4,390,104 by Cummings; 4,423,819 by Cummings; 4,514,248 by Cummings; 4,527,703 by Cummings and 4,598,834 by Singletary.

A medical seal is generally constructed using a foil/plastic laminate seal member that is adhesively attached to a release liner formed on one side of a long carrier strip. Each seal includes an adhesive surface surrounding a sterile adhesive-free area. The sterile adhesive-free area is placed into contact with the injection membrane of the IV container, and the surrounding adhesive is adapted for attaching the seal around the port. Many individual seals are attached to a carrier liner so as to be dispensed one at a time. The strip of medical seals is wound around an annular core, usually 1,000 seals per roll. The roll of seals undergoes a process in which the seals are sterilized, including the adhesive surface and the adhesive-free area. Once the adhesive-free area is sterilized, it remains sterilized until removed from the carrier liner prior to being placed on the injection membrane of the IV container. Thus, the sterility of the procedure is not compromised, which would otherwise allow bacteria and other particles to contaminate the injection membrane or the contents of the IV bag.

The dispensing of the individual seals is carried out in such a manner so as to maintain the original sterility thereof. If a seal is dispensed from the roll and not used immediately thereafter to seal the injection port of a medical container, then it must be discarded. In the event that a portion of a seal is inadvertently lifted from the carrier strip and not immediately used, then it must also be discarded. The partial lifting of a seal from the carrier strip may prematurely occur when the carrier strip is pulled around the outlet corner of the dispenser box in which the roll of seals is stored, or the roll is inadvertently spun inside the box when the carrier strip is pulled too fast, in which event a length of the carrier strip will unwind inside the dispenser box. The unwinding of the carrier strip inside the dispenser box can allow portions of the seals to be prematurely lifted from the carrier strip.

The core on which the roll of seals is wound is made from various materials, primarily paper or plastic. Although the core is specified to be a certain diameter, such as three inches in diameter, the actual diameter of the core often varies plus or minus several thousandths of an inch, with paper cores having the widest variance. The variance in the core diameter causes some rolls to be tight when placed on a core holder located in the dispenser box. The tight fit between the core of the carrier strip roll and the core holder makes it difficult to pull the strip out of the dispenser box and dispense the seals from the strip. When the core of the roll of seals is slightly oversized and fits loosely on the core holder of the dispenser, the roll of seals will spool or rotate freely on the core holder, thus tending to tangle the strip of seals inside the dispenser box.

Conventional seal dispensers include a plastic insert that holds a roll of seals inside a paper/chipboard folding carton or box. The roll of seals is placed onto the core holder and the end of the carrier strip is routed over the exit hump formed on the plastic insert, and then routed through a small slit in the edge of the dispenser box. The plastic insert, with the roll of seals thereon, is inserted into the dispenser box. The lid of the box is then taped shut. The exit hump formed on the plastic insert is intended to provide a gentle curved path over which the carrier strip is pulled. This exit structure is intended to eliminate the sharp exit corner which would otherwise allow the seals to prematurely lift off of the carrier strip when the strip is pulled out of the box around the sharp corner of the box itself.

If the roll of seals inside the dispenser box spins or spools excessively when dispensing, loops in the carrier strip are created inside the dispenser box and the inadvertent lifting of the seal from the carrier strip can occur. When a technician pulls down too quickly on the carrier strip during dispensing of seals from the box, or with too great a force, the roll of seals can continue to spin on the core holder of the dispenser. As noted above, when the roll of seals spools or spins inside the dispense box, an excess length of the carrier strip is unrolled inside the dispenser box. This can cause folding or bending of the carrier strip inside the dispenser box to a degree that one or more of the seals can prematurely lift off of the release liner of the carrier strip, thus allowing the sterile target area of the seal to be exposed.

Problems and limitations with the standard dispenser box include the following. First, the plastic insert tends to slide and move around in the dispenser box during dispensing, and moves away from the sharp corner of the box near the small exit slit. This movement permits the position of the exit hump on the insert to move away from the slit in the box and allow the carrier strip to be pulled at such a sharp angle that allows the seals to prematurely lift off the carrier strip and expose the sterile area on the seals to contaminants. Secondly, the dispenser box needs to be positioned by the user so that the carrier strip pulled from the box exits from the bottom of the box to prevent premature lifting of the seals off the carrier strip. Thirdly, the plastic insert and core holder formed thereon are often slightly too large in diameter for some rolls, and too small for other rolls. Thus, a smooth rolling motion of the core on the plastic insert, with a small amount of drag, is not obtained, whereupon the carrier strip must be pulled with an excessive force, or the roll of seals spins too freely. Fourth, the entire dispenser requires assembly of the folding carton and insertion of plastic insert and roll of seals therein.

From the foregoing, it can be seen that a need exists for a medical seal dispenser that overcomes the foregoing, and other problems and shortcomings. A need exists for a medical seal dispenser where the plastic insert and the container box are integrated together to make the product more cost effective, and to prevent relative movement between such components. Another need exists for a medical seal dispenser that is constructed as a unitary item, and opens like a clamshell to allow easy insertion of the roll of seals therein, and then snap locks together. Another need exists for a medical dispenser that includes a core holder adapted for manually adjusting the amount of drag on the core, as a function of the particular inside diameter of the core. Another need exists for a medical seal dispenser that is easily constructed and reliable in operation.

SUMMARY OF THE INVENTION

In accordance with the principles and concepts of the invention, disclosed is a medical seal dispenser in which the core holder and the dispenser container are made integral and of a unitary construction.

In accordance with a feature of the invention, disclosed is a dispenser formed as a clamshell from thermoformed plastic, where the dispenser prevents jamming, spooling and accidental or premature lifting of the sterile seal from the carrier strip.

The medical seal dispenser constructed according to the invention allows free, but controlled movement of the carrier strip from the roll, one at a time at the discretion of the user. This prevents spooling of the roll of seals inside the dispenser and possible tangling of the strip and premature release of one or more seals from the carrier strip.

According to another feature of the invention, the seal dispenser incorporates "speed bumps" on the core holder to create sufficient friction to prevent excessive spin or back spinning and/or looping of the carrier strip. One or more speed bumps can be utilized, depending upon the width and weight of the roll of seals, and the inside diameter of the roll being dispensed. The speed bumps are formed so as to allow them to be manually popped inward when too much friction exists. This feature allows the technician to fine tune the amount of drag desired for each roll of seals.

The seal dispenser of the invention incorporates an exit hump over which the carrier strip and attached seals are pulled at an angle less than that necessary to allow the seals to prematurely lift or become detached from the carrier strip. The packaging of the roll of seals does not require any box with a slit therein, so the carrier strip cannot be pulled around any sharp corner.

The seal dispenser according to one embodiment of the invention includes a clamshell design having two halves that fold together and capture the roll of seals therein. Prior to folding the clamshell halves together, the roll of seals is inserted on the core holder which is formed on one half of the clamshell, and the carrier strip is threaded to the exit area over the exit hump. The clamshell halves are folded together and snap locked to hold the two clamshell halves together. The exit hump is split into two halves, one half formed with each half of the clamshell. When the clamshell halves are folded together, the end of the core holder on one clamshell portion is nested into a corresponding annular receiver of the other clamshell portion to lock the clamshell portions together.

The advantages of the seal dispenser of the invention include one or more of the following. The clamshell dispenser replaces standard paper/cardboard dispenser boxes and offers several additional advantages, including reduction of paper lint from the dispenser box that can otherwise contaminate a sterile environment in which the seals are dispensed, greater strength, roll control to reduce excessive spinning, and the ability to position the seal dispenser in alternative positions for dispensing. The overall cost of the dispenser is reduced, the plastic dispenser can be wiped with a cleaning agent prior to placement in sterile filling area, the speed bumps allow tight rolls to compress bumps for easier dispensing of small diameter cores, the speed bumps can be reduced in number to allow a technician to adjust carrier liner tension to a preferred amount, the exit hump does not move inside dispenser, thus maintaining the proper exit position, and the overall assembly of the product can be carried out much more quickly.

According to one embodiment of the invention, disclosed is a dispenser for dispensing items attached to a carrier strip wound on a core member. The dispenser includes a container for housing the carrier strip roll, and a core holder that is housed within the container. The core holder is adapted for holding the carrier strip which is wound around the core member. The core holder has at least one speed bump comprising a protrusion extending radially from a surface of the core holder to provide friction to an inner surface of the core member when the core member rotates during dispensing of the carrier strip. The speed bump is adapted for being deformed inwardly to reduce an extent of the protrusion.

According to another embodiment of the invention, disclosed is a dispenser for dispensing items attached to a carrier strip wound in a roll. The dispenser includes a container having a first container portion, a second container portion, and a folding spine adapted for allowing the first container portion and the second container portion to be folded together in a closed position. A locking means is provided for locking the first and second container portions together in the closed position. A cylindrical core holder is provided for supporting the carrier strip roll. The cylindrical core holder has at least one speed bump for engaging an inner cylindrical surface of the carrier strip roll to provide rolling friction thereto. An exit hump is formed integral with the container and over which the carrier strip is routed.

According to a fabrication technique of the invention, disclosed is a method of constructing a dispenser for dispensing items attached to a carrier strip wound in a roll. The method includes forming a sheet of plastic into a clamshell container having a first container portion hinged to a second container portion so that the first and second container portions can be moved together to a closed position. A locking mechanism is formed for locking the first container portion to the second container portion when in the closed position. A core holder is formed on one of the container portions, and the core holder is adapted for holding the carrier strip roll. One or more speed bumps is formed on an outer periphery of the core holder, where each said speed bump includes a bubbled out portion of the core holder that can be deformed inwardly to adjust a radial height of the speed bump.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIG. 2 is a bottom view of the clamshell dispenser of FIG. 1;

FIG. 3*a* is a top view of the clamshell dispenser of FIG. 1;

FIG. 3*b* is a partial cross-sectional view of the clamshell dispenser taken along line 3*b*-3*b* of FIG. 3*a;*

DETAILED DESCRIPTION OF THE INVENTION

Figure 1:
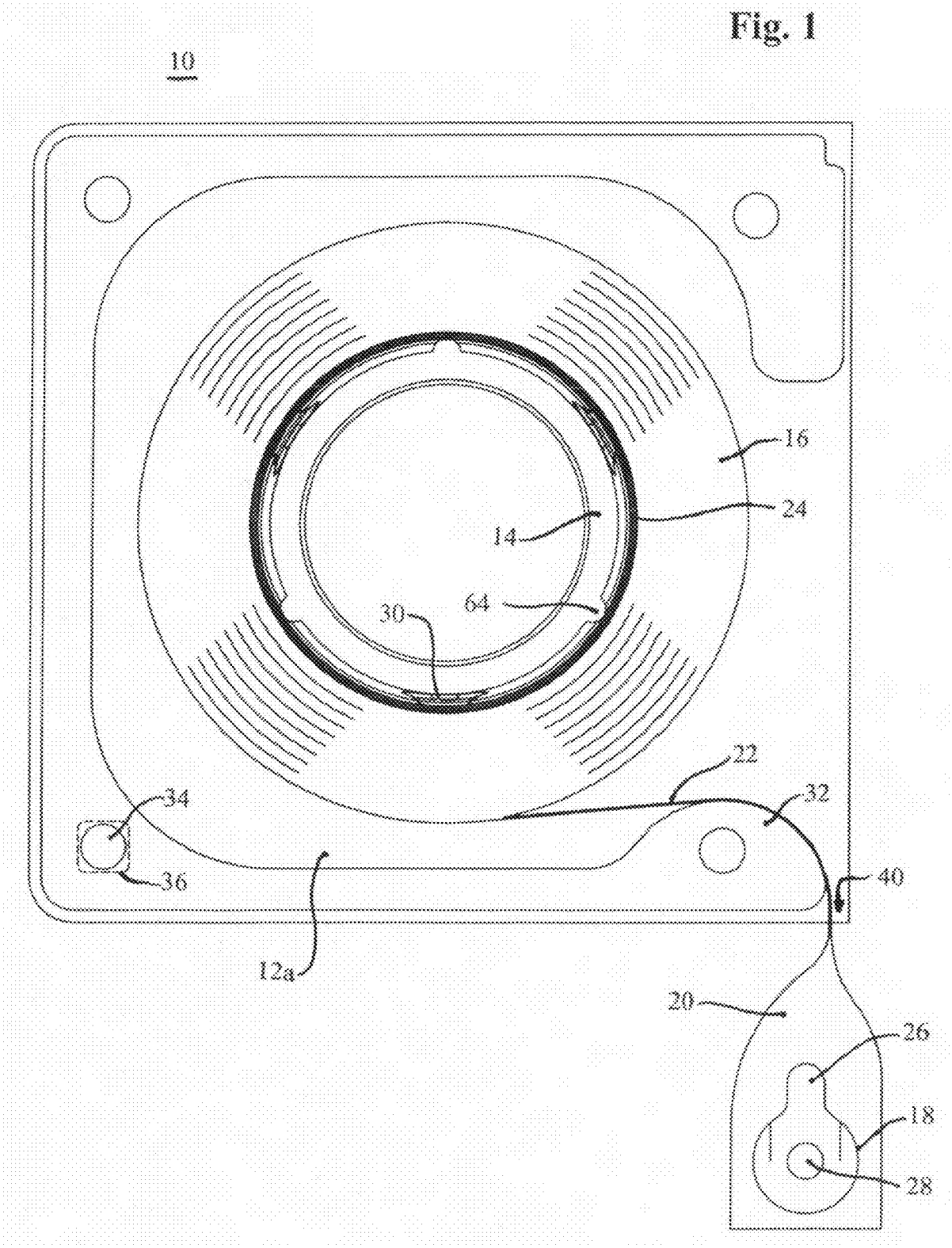
FIG. 1 is a side view of the clamshell dispenser constructed according to a preferred embodiment of the invention.

Referring now to FIG. 1 of the drawings, there is shown a side view of the seal dispenser 10 constructed according to a preferred embodiment of the invention. The dispenser 10 is fabricated by thermoforming techniques using a clear PVC type of plastic material. According to this technique, a sheet of plastic is placed over the mold and a vacuum is applied to the mold while the plastic is heated to thereby pull the pliable plastic material into the mold and into a shape conforming to that of the mold. The thickness of the plastic sheet material can be 0.25 inch, or other suitable thickness. Other molding techniques and other types and colors of plastics can be employed. As can be seen, the plastic clamshell dispenser needs no separate box as part of the packaging or dispensing of the seals.

FIG. 1 illustrates the side view of one half 12*a* of the transparent, plastic clamshell dispenser 10. Formed on the clamshell half 12*a* is a cylindrical core holder 14 for supporting a roll 16 of seals, one seal 18 shown on the carrier strip 22 ready to be dispensed. As noted above, the seals 18 are adhered to a release liner 20 formed on one side of the carrier strip 22. The pull tab 26 and the sterilized target area 28 are free of adhesives and thus are not adhered to the release liner portion 20 of the carrier strip 22. A technician can remove the seal 18 from the carrier strip 22 by simply grasping the pull tab 26 and peeling the seal 18 from the release liner 20 side of the carrier strip 22. As noted above, the carrier strip 22 is rolled onto a core 24 formed of plastic or a stiff paper.

According to an important feature of the invention, the plastic core holder 14 is constructed with one or more speed bumps, one shown as numeral 30. In the embodiment shown in FIG. 1, the core holder 14 is formed with two speed bumps. In practice, it has been found that two or three speed bumps 30 formed on the core holder 14 is sufficient to control the friction between the core holder 14 and the core 24 of the roll 16 of seals. However, any other reasonable number of speed bumps 30 can be employed to achieve the purpose stated herein. The speed bump 30 is simply a portion of the core holder 14 bubbled outwardly to form a protrusion or domed area that can be elevated above the surface in the range of about 0.075 inch to about 0.25 inch. The diameter of each speed bump can be in the range of about 0.5 inch to about 1.0 inch. The outermost surface of the speed bump 30 engages the inner cylindrical surface of the core 24 of the roll 16 of seals.

Importantly, in the event that the inside diameter of the core 24 of the roll of seals is smaller than specified, then less friction is required in order to control the spin of the roll 16 when rotated as a result of the pulling the carrier strip 22 out of the dispenser 10 to expose the next seal 18. In order to reduce the friction on the roll 16 as it is rotated, the technician can unsnap the clamshell dispenser 10 to open it and gain access to the roll 16. The roll 16 of seals can be removed from the core holder 14 and one or more of the speed bumps 30 can be manually pressed in by the technician's finger. The bubble bump 30 pressed in will then remain in the depressed condition and will not thereafter engage the inside cylindrical surface of the core 24 of the roll 16 of seals. With fewer speed bumps engaging the inside surface of the core 24, the friction is reduced and the roll 16 of seals is easier to rotate during dispensing. In the event that the technician finds that too many speed bumps have been pressed in and the friction is reduced too much, the reverse operation can be carried out to press a speed bump out to again cause it to engage with the inner surface of the core 24 of the roll 16 of seals. With the foregoing structure, the friction on the roll 16 can be controlled by the technician to prevent spooling of the roll 16, but yet be able to accommodate roll cores 14 with diametric differences.

The carrier strip 22 is routed from the roll 16 (counterclockwise, as shown), and over an exit hump 32 and out of the dispenser 10 by way of a slot, not shown in FIG. 1. The exit hump 32 prevents the carrier strip 22 from undergoing excessive bending which leads to premature separation of the leading edge of the seal 18 from the release liner 20. The carrier strip 22 is shown twisted a quarter turn in FIG. 1 to illustrate the placement of the seal 18 on the release liner 20. In practice, the carrier strip 22 is not twisted by the technician during dispensing of a seal 18. As will be shown and described below, one half of the exit hump 32*a* is formed on one half 12*a* of the clamshell dispenser 10, and the other half 32*b* (FIG. 4) of the exit hump 32 is formed on the other half 12*b* of the clamshell dispenser 10.

The clamshell halves 12*a* and 12*b* are held together with snap lock mechanisms, one shown as numeral 34. The clam shell half 12*a* shown in FIG. 1 is formed with cylindrical posts 34 that are snapped into square receptacles 36 formed in the other clamshell half 12*b*. Four such snap lock structures are formed in the clamshell dispenser 10, one at each corner of the dispenser 10. The full insertion of cylindrical post 34 into the corresponding square receptacle 36 maintains the clamshell halves 12*a* and 12*b* locked together and the roll 16 of seals captured for rotation on the core holder 14. As will be described below, the core holder 14 on the clamshell half 12*a* also locks into an annular ring 68 formed on the other clamshell half 12*b*. This locking arrangement has been found to be satisfactory to maintain the clamshell halves 12*a* and 12*b* locked together even if dropped, but allows a technician to pry the clamshell halves 12*a* halves 12*a* and 12*b* apart to adjust the friction or replace a roll 16 of seals or otherwise rethread the carrier strip 22 from the roll 16 through the slot to allow access for pulling on the same to dispense a seal 18.

The snap lock mechanism of the preferred embodiment comprising the posts 34 and the square receptacles 36 can of course be other shapes to provide the requisite friction therebetween to maintain the clamshell halves 12*a* and 12*b* locked together. The locking mechanism can be male and female engaging members of the same general shape that are frictionally locked together. The snap lock mechanism can be complementary square, round, oval, rectangular, or any other suitable shape. In addition, the clamshell halves 12*a* and 12*b* can be formed with over-center or catch type of snap lock closure members, without being of the male-female type.

FIG. 2 illustrates the structural features of the clamshell dispenser 10 from the bottom, and FIG. 3*a* illustrates the features of the clamshell dispenser 10 from the top thereof. FIG. 2 shows the clamshell half 12*a* locked to the other clamshell half 12*b* using the posts 34 and the corresponding square receptacles 36. The interface edge 38 is where the edge of one clamshell half 12*a* abuts the edge of the other clamshell half 12*b*. The slot 40 is formed by an opening in both clam shell halves 12*a* and 12*b* near the bottom corner of the dispenser 10. As described above, the carrier strip 22 is threaded off the roll 16, over the exit hump 22 and through the slot 40.

FIG. 3*a* illustrates a top view of the clamshell dispenser 10. The halves 12*a* and 12*b* of the clamshell dispenser 10 are joined together with a plastic spine 42. As will be described more fully below, the spine 42 is angled inwardly to provide strength thereto. The plastic spine 42 extends the entire width of the clamshell dispenser 10, and along an entire edge thereof.

FIG. 3*b* is a cross-sectional view of the sides of the clamshell halves 12*a* and 12*b* illustrating the interface 38. The clamshell halves 12*a* and 12*b* are formed with circumferential offset dogleg structures 44 and 46 that interengage and provide lateral stability and strength to the dispenser 10.

Figure 4:
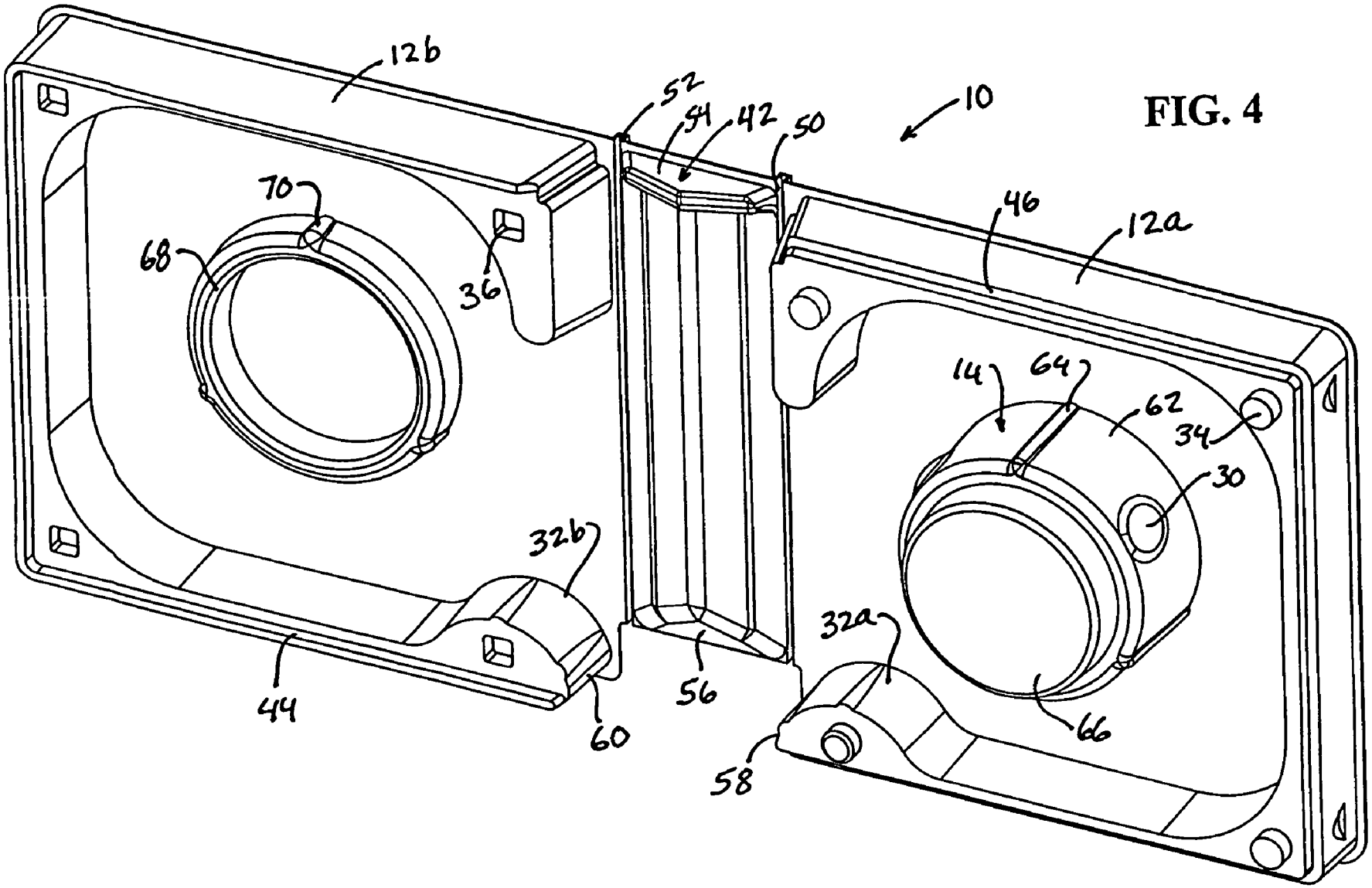
FIG. 4 is an isometric view of the clamshell dispenser in an opened position.
Figure 5:
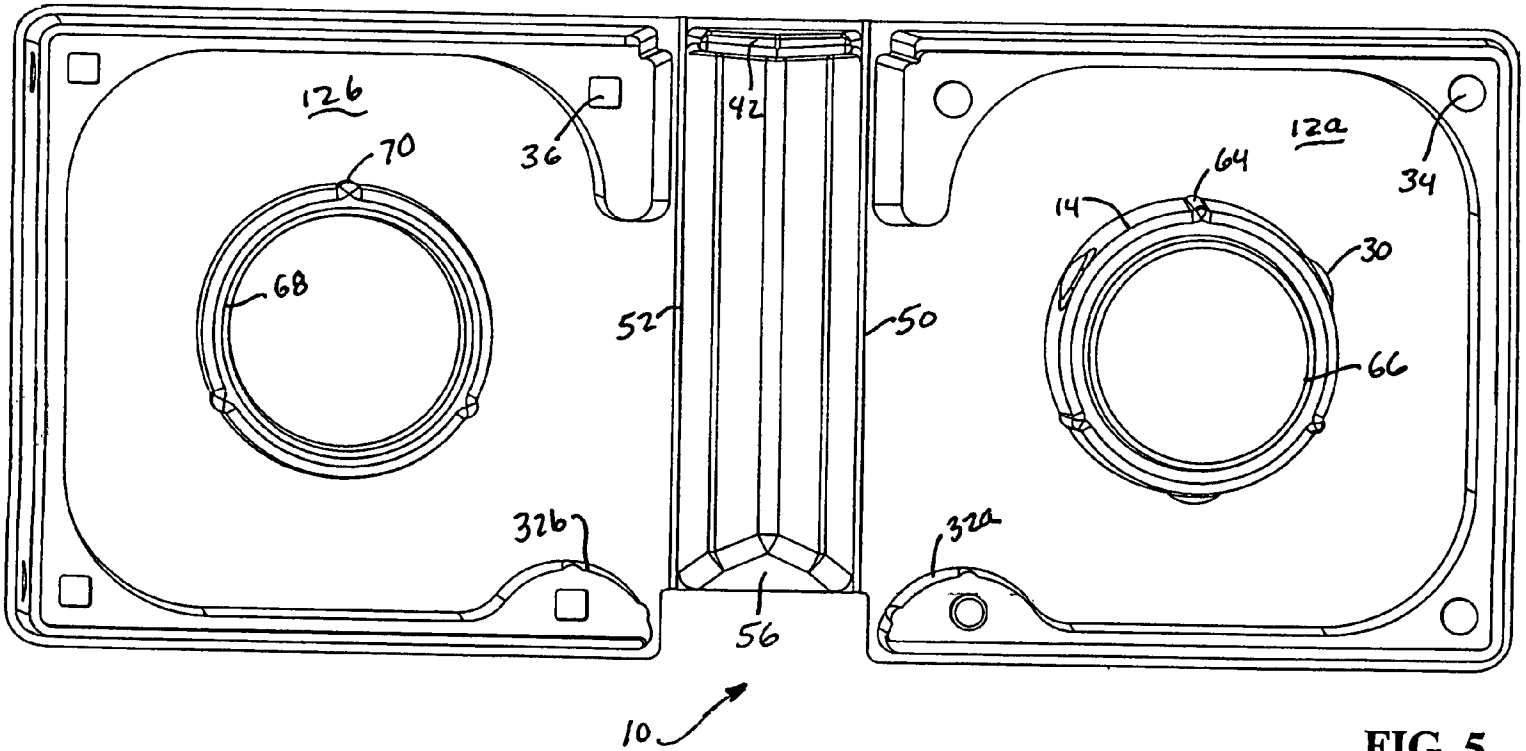
FIG. 5 is a side view of the opened clamshell dispenser.
Figure 6:
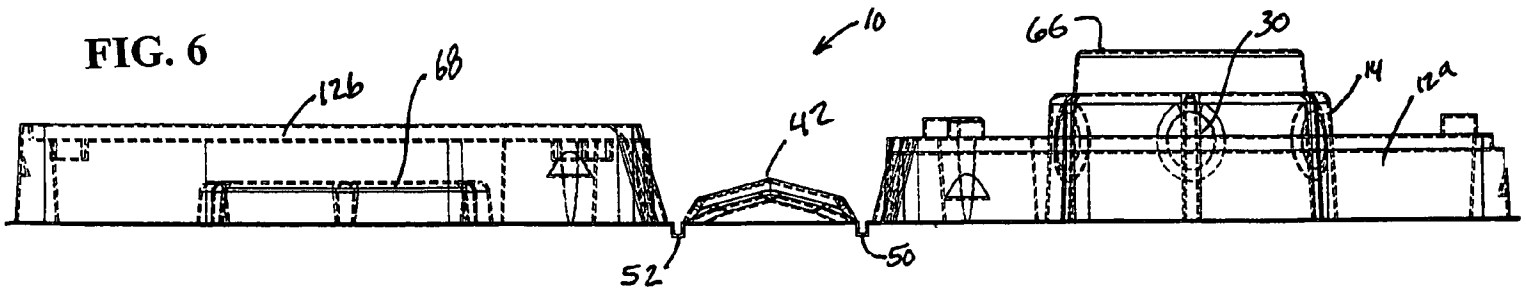
FIG. 6 is a bottom edge view of the opened dispenser of FIG. 5.

FIGS. 4-6 illustrate the structural features of the clamshell dispenser 10. Shown is the clamshell half 12*a* and clamshell half 12*b* connected by the spine 42. The spine 42 is the width of the dispenser 10 and is connected to clamshell half 12*a* by a first fold line 50, and connected to the other clamshell half 12*b* by a second fold line 52. As shown in FIG. 6, the spine 42 is formed with an angle for purposes of strength. The top of the spine 42 includes a triangular-shaped part 54 (FIG. 4) which mates with corresponding angled edges of the clamshell halves 12*a* and 12*b*, also shown in FIG. 3*a*. The bottom part of the spine 42 shown in FIG. 4 includes an edge 56 which forms a part of the exit slot 40 through which the carrier strip 22 is threaded. The edge 56 of the spine 42 is spaced from the corresponding edges 58 and 60 of the clamshell halves 12*a* and 12*b* to form the exit slot 40. As shown, the slot 40 is located at the curved end of the exit hump 32 so that the carrier strip 22 exits the clamshell dispenser 10 without any sharp edges that could otherwise cause premature detachment of the seal 18 from the carrier strip 22.

The clamshell half 12*a* is formed generally symmetrical to the clamshell half 12*b*, except for the cylindrical locking posts 34 on clamshell half 12*a* and the square receptacles 36 formed in clamshell half 12*b*. The other exception of the symmetrical construction of the dispenser 10 is the core holder 14. The core holder 14 includes a cylindrical hub 62 on which the core 24 of the roll 16 of seals is inserted. The hub 62 includes plural transverse ribs 64 to provide strength and rigidity to the core holder 14. While the hub 62 of the core holder 14 is formed with a draft, according to normal molding procedures, the ribs 64 function to provide lateral surface areas without a draft angle to accept the cylindrical core 24 of the roll 16 thereon. Also formed on the hub 62 of the core holder 14 are the speed bumps 30, described above.

At the internal end of the hub 62 is a stub 66 that frictionally fits within an annular ring 68 formed in the other clamshell half 12*b*. The annular ring 68 is formed with reinforcing ribs 70 that engage with the inner cylindrical surface of the core 24 of the roll of seals. When the stub 66 of the core holder 14 is fully engaged with the annular ring 68, the locking of the clamshell halves 12*a* and 12*b* together is facilitated.

The opened clamshell dispenser 10 shown in FIG. 4 appears to have solid portions. However, the clamshell dispenser 10 is preferably formed of a sheet of plastic, and thus all surfaces and portions of the clamshell dispenser are only the thickness of a sheet of plastic. This simplifies the fabrication of the dispenser 10 and reduces the cost and weight thereof. Because of the locking mechanisms, and the reinforcement formed into the structure, the dispenser 10 is sturdy and not easily opened unless intentionally pried apart with a person's hands.

Once the roll 16 of medical seals has been inserted in the dispenser 10 and the clamshell halves 12*a* and 12*b* snap locked together, the dispenser 10 and roll of seals 16 are processed to sterilize the entire unit. The entire packaged unit 10 can be sterilized by placing a number of dispensers 10 in a conventional enclosed and controlled environment and subjected to a sterilizing gas, such as ethylene oxide. Any other acceptable sterilization process can be carried out to sterilize the seals, especially the adhesive free area 28 that is placed against the rubber membrane of the IV container port. It is understood that even when the adhesive free area 28 of the seal 18 is surrounded by adhesive and adhered to the release liner side 20 of the carrier strip 22, the sterilizing process nevertheless sterilizes the inaccessible adhesive free area 28 of the seal 18.

From the foregoing, disclosed is a medical seal dispenser that accommodates rolls of seals having different inside diameter dimensions, so that the friction thereon can be controlled and provide a smooth rotating motion to the roll when the carrier strip is pulled to dispense a seal. The hub of the dispenser on which the roll of seals is rotated for dispensing a seal, includes deformable protrusions for adjusting the rotating friction imparted to the roll of seals. The dispenser is constructed as a unitary structure to hold the roll of seals on a hub, as well as provide a container for containing the roll of seals. The dispenser is molded as halves, and snap fit together to reliably hold the roll of seals contained therein, but allowed to be opened by the user to either replace the roll of seals, or adjust the rotating friction of the roll of seals.

Figure 7:
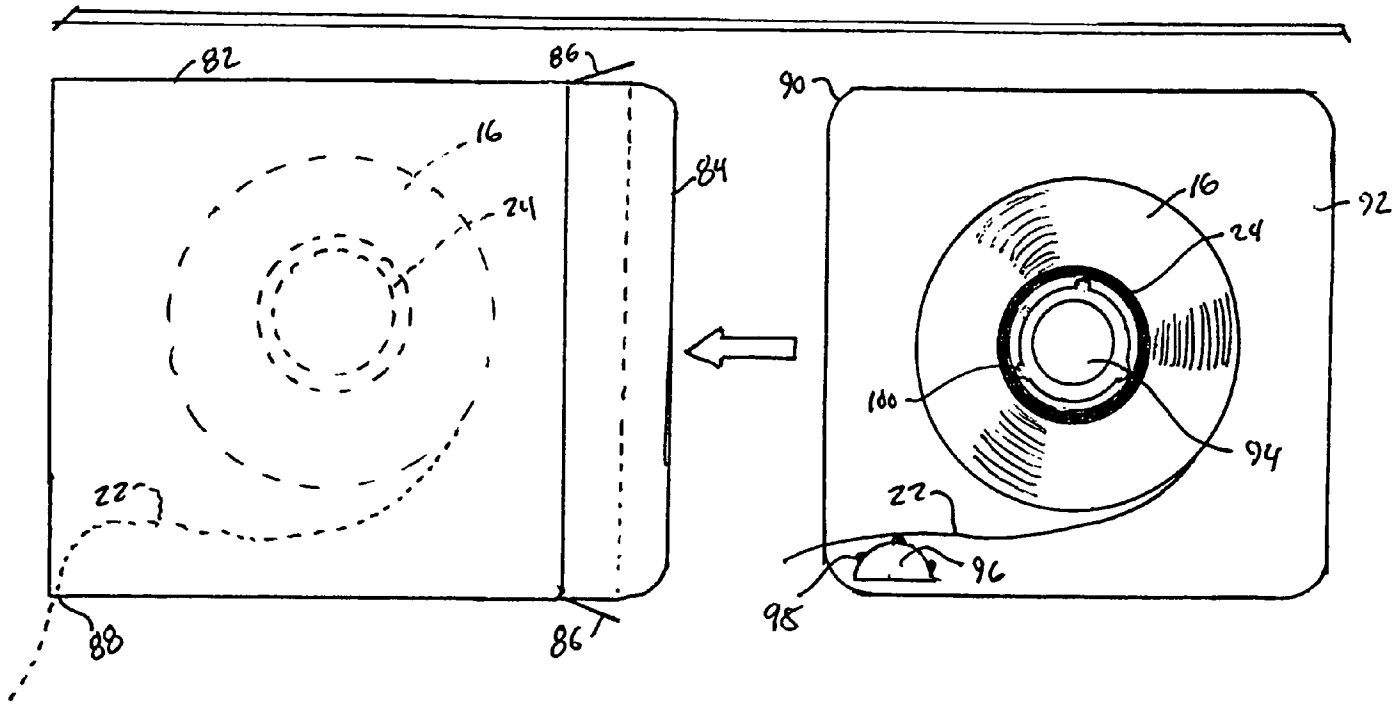
FIG. 7 illustrates another embodiment of the invention, in which the conventional plastic holder insertable into a package box is equipped with speed bumps.
Figure 8:
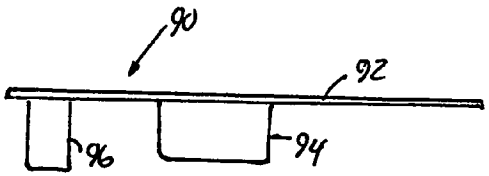
FIG. 8 is a frontal side view of the plastic holder insert of FIG. 7.
Figure 9:
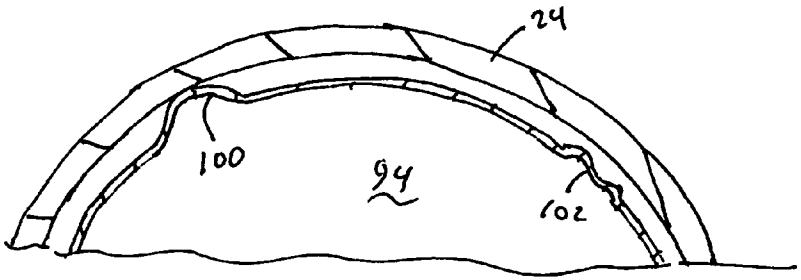
FIG. 9 is an enlarged cross-sectional view of a portion of the hub, showing the speed bumps engaging with the inner surface of the core on which the carrier strip is wound.

While the preferred embodiment has been disclosed with reference to an integral container and core holder, other alternatives are available, including the alternative embodiment 80 of FIGS. 7-9. Here, there is illustrated a conventional dispenser box 82 constructed of a heavy paper material. The box 82 includes a major flap 84 and two minor flaps 86. Also included in the rear portion of the box 82 is an exit slot 88 through which the carrier strip 22, shown in phantom, exits the dispenser box 82. The entire roll 16 of medical seals is shown in phantom wound around a core 24, and is illustrated in a position in the box 82 ready to be dispensed.

As a conventional practice, the roll 16 of medical seals is placed on a planar holder 90 that holds the roll 16 of medical seals. The end of the carrier strip is first threaded through the slot 88 in the rear of the box 82, and then the holder 90 and roll 16 placed thereto are inserted into the box 82 as a unit. Once the holder 90 is fully inserted into the box 82, the slack in the carrier strip 22 is taken up, and the end of the carrier strip 22 is temporarily taped to the outside of the box. The flaps 84 and 86 are folded and closed in a conventional manner to close the dispenser box 82 with the holder 90 and roll 16 therein. In this manner, when the technician is ready to dispense a medical seal 18, all that needs to be done is untape the end of the carrier strip 22 and pull on it to expose the first seal. The unadhered pull tab 26 portion of the seal 18 can be lifted and pulled so as to remove the seal 18 from the release liner portion 20 of the carrier strip 22.

A frontal view of the insertable holder 90 is shown in FIG. 8. The front of the holder 90 is the end that enters the dispenser box 82 first. The holder 90 is fabricated by thermal vacuum forming mold techniques using a thin sheet of plastic. The holder 90 includes a planar base 92 to which a core holder or hub 94 and a hump 96 are integrally molded. The core 24 of the roll 16 of seals is placed on the hub 94, and the carrier strip 22 is routed over the hump 96 as shown in FIG. 7. The box 82 keeps the roll 16 of seals on the hub 94. While not shown, the hub 94 includes a number of raised radial ridges with which the inside of the core 24 traditionally engaged with as the roll 16 of seals 18 was unrolled during dispensing of the seals 18. The hump 96 also includes similar ridges 98 formed thereon. The ridges on the hub 94 as well as on the hump 96 function to provide strength and rigidity to the structures.

In accordance with an important feature of the invention, the holder 90 is formed with the hub 95, and with speed bumps 100 on the hub 94. FIG. 9 illustrates the speed bumps 100 in detail. The speed bump 100 is shown bubbled outwardly to engage with the inside surface of the core 24 on which the carrier strip 22 of seals 18 is wound. The other speed bump 102 is shown pressed inwardly to reduce the effectiveness thereof in the event too much friction exists between the hub 94 and the core 24. The speed bumps 100 are otherwise constructed and function in the same manner as described above in connection with the preferred embodiment. Accordingly, even when employing the conventional method of packaging and dispensing medical seals or other articles, the holder 90 can be constructed with a hub having speed bumps 100 to control and otherwise reduce spooling of the roll 16.

While the preferred and other embodiments of the invention have been disclosed with reference to a specific medical seal dispenser, it is to be understood that many changes in detail may be made as a matter of engineering choices without departing from the spirit and scope of the invention, as defined by the appended claims.

What is claimed is:

1. A dispenser for dispensing items attached to a roll of carrier strip wound on a core member, said dispenser comprising:

a container for housing said roll of carrier strip;

a core holder housed within said container, said core holder adapted for holding said core member around which the carrier strip is wound;

said core holder having at least two speed bumps, a first speed bump comprising a protrusion extending radially outwardly from a surface of said core holder to provide friction to an inner surface of the core member when said core member rotates during dispensing of the carrier strip, said first speed bump is deformable radially inwardly; and said core holder having a second speed bump that is deformed radially inwardly to reduce an extent of the deformed second speed bump, and said radially inwardly deformed second speed bump remains deformed inwardly when the roll of carrier strip and the core member are removed from said core holder.

2. The dispenser of claim 1, wherein each said speed bump is dome shaped before being deformed.

3. The dispenser of claim 1, wherein each said speed bump is constructed with a thin deformable material, and as a dome-shaped member so as to be pressed inwardly by a user of the dispenser and deformed from the dome shape.

4. The dispenser of claim 1, further including a plurality of said speed bumps equidistantly spaced around said core holder, and each said speed bump can be deformed radially inwardly by a user of the dispenser.

5. The dispenser of claim 1, wherein said core holder is formed of a thin plastic material, and each said speed bump is also formed of said thin plastic material.

6. The dispenser of claim 5, wherein said container is formed as a first portion and a second portion, and said core holder is integral with one said first or second container portion.

7. The dispenser of claim 6, wherein said container and said core holder are formed of a thin plastic material.

8. The dispenser of claim 1, wherein said deformed second speed bump can be pushed back to an original protrusion shape.

9. The dispenser of claim 1, wherein said core holder has a cylindrical surface, and wherein each said speed bump is a dome-shaped deformable protrusion protruding from the cylindrical surface of said core holder.

10. The dispenser of claim 6, further including a hump over which the carrier strip is dispensed, and wherein said first container portion and said second container portion each include a portion of said hump.

11. The dispenser of claim 1, wherein said container is constructed with a first portion and a second portion, and said core holder is formed integral with said first container portion, and said second container portion includes a female receptacle into which an end of said core holder is insertable and friction fit therewith.

12. The dispenser of claim 1, wherein said container is constructed of plastic and formed as a clamshell having portions foldable together to a closed position, and further including at least one male member, each male member friction fittable into a corresponding female member, said male and female members for locking the clamshell portions in the closed position.

13. A dispenser for dispensing items attached to a carrier strip wound in a roll, said dispenser comprising:

a container including a first container portion, a second container portion, and a folding spine adapted for allowing said first container portion and said second container portion to be folded together in a closed position to form an enclosure housing the roll of carrier strip;

locking means for locking said first and second container portions together in the closed position;

a cylindrical core holder for supporting the roll of the carrier strip thereon, said cylindrical core holder formed integral with said first container portion;

said cylindrical core holder having plural spaced apart speed bumps comprising deformable protrusions extending radially outwardly from an outer cylindrical surface of said cylindrical core holder, each said speed bump for engaging an inner cylindrical surface of the roll of the carrier strip when not deformed to provide rolling friction thereto, and each said speed bump adapted for being deformed inwardly so as not to frictionally engage the inner cylindrical surface of the roll of the carrier strip;

an end of said cylindrical core holder having a reduced diameter cylindrical stub; and an annular ring formed integral with said second container portion, said annular ring having an inner cylindrical surface for friction fitting therein of an outer cylindrical surface of the cylindrical stub of said cylindrical core holder, whereby said first and second container portions are held together.

14. The dispenser of claim 13, further including;

an exit hump formed integral with said container and over which the carrier strip is routed; and a slot in said container through which the carrier strip is routed when unrolled so that the items attached to the carrier strip can be dispensed.

15. The dispenser of claim 13, wherein said dispenser is constructed of a single sheet of plastic.

16. A dispenser for dispensing items attached to a roll of carrier strip wound on a core member, said dispenser comprising:

a container for housing said roll of carrier strip;

a core holder housed within said container, said core holder adapted for holding said core member around which the carrier strip is wound;

said core holder having a generally cylindrical portion with a given diameter that does not change during use of the dispenser, and said core holder having an effective diameter that can be changed to accommodate core members of differing inside diameters, the effective diameter of said core holder being greater than the given diameter of the cylindrical portion; and the effective diameter of said core holder being changeable to maintain the same rolling friction between the core holder and core members of differing inside diameters, the effective diameter of said core holder being changeable because of one or more deformable speed bumps formed on the cylindrical portion of said core holder, each said one or more deformable speed bumps comprising a respective protrusion extending radially outwardly from the cylindrical portion, and an outer surface of each said one or more deformable speed bumps engaging an inner surface of the core member to provide rolling friction thereto when said core member rotates on said core holder during dispensing of the carrier strip, each said speed bump is deformable radially inwardly to reduce an extent of the protrusion thereof without deforming the cylindrical portion of the core holder to thereby reduce the effective diameter of the core holder, and when a respective speed bump is deformed inwardly, the inwardly deformed speed bump remains deformed inwardly when the roll of carrier strip and the core member are removed from said core holder, whereby the effective diameter of the core holder does not increase when the core member is removed from the core holder.

17. The dispenser of claim 16, wherein each said one or more speed bumps is constructed as a dome-shaped member and of a thin plastic material so as to be deformable radially inwardly and remain deformed inwardly, and each said one or more speed bumps are constructed so that once deformed radially inwardly, the deformed speed bump can be pushed back radially outwardly to substantially the same original dome shape and thereby increase the effective diameter of the core holder.

18. The dispenser of claim 17, wherein the core holder of said dispenser is constructed so as to accommodate core members with differing inside diameters and provide the same rolling friction to the core members of differing inside diameters.

19. The dispenser of claim 16, wherein said core holder is constructed of a thin plastic material, and the cylindrical portion of said core holder includes stiffening ribs.

20. The dispenser of claim 16, wherein said container comprises:

a first container portion, a second container portion, and a folding spine adapted for allowing said first container portion and said second container portion to be folded together in a closed position to form an enclosure housing the roll of carrier strip; and locking means for locking said first and second container portions together in the closed position.

* * * * *